US006895958B1

(12) United States Patent
Komosky

(10) Patent No.: US 6,895,958 B1
(45) Date of Patent: May 24, 2005

(54) FIREPLACE COOKING APPARATUS WITH REMOVABLE GRILLS

(76) Inventor: Richard P. Komosky, 5520 Eton Ct., Boca Raton, FL (US) 33486

( * ) Notice: Subject to any disclaimer, the term of this patent is extended or adjusted under 35 U.S.C. 154(b) by 0 days.

(21) Appl. No.: 10/613,292

(22) Filed: Jul. 3, 2003

(51) Int. Cl.[7] ..... F24B 1/182
(52) U.S. Cl. ..... 126/506; 126/25 A; 126/29
(58) Field of Search ..... 126/506, 505, 126/25 A, 29, 30, 25 R; 99/393, 402; 248/125.1

(56) References Cited

U.S. PATENT DOCUMENTS 3,359,887 A * 12/1967 Cleveland ..... 126/29
3,481,267 A * 12/1969 Saiki ..... 126/25 R
3,630,188 A * 12/1971 Ross ..... 126/506
3,834,370 A 9/1974 Nelson
4,083,354 A 4/1978 Claire et al.
4,086,905 A * 5/1978 Dawson ..... 126/505
4,117,825 A * 10/1978 Robertson ..... 126/29
4,256,080 A 3/1981 Seach
4,413,609 A 11/1983 Tisdale
4,548,193 A * 10/1985 Marogil ..... 126/30
4,553,525 A 11/1985 Ruble
4,766,879 A * 8/1988 Freese ..... 126/30
4,796,599 A * 1/1989 Cooper ..... 126/30
4,911,146 A 3/1990 Pushee

FOREIGN PATENT DOCUMENTS

CH 625 951 A5 * 10/1981

* cited by examiner

*Primary Examiner*—Josiah C. Cocks
(74) *Attorney, Agent, or Firm*—Ronald V. Davidge

(57) ABSTRACT

A frame holding removable food grills is provided for cooking food within a fireplace. The frame extends behind and below a convention grate holding a fire within the fireplace. The grills are removably held in slots within the frame, with a number of slots being provided for placing the grills at various distances above the fire.

11 Claims, 2 Drawing Sheets

FIREPLACE COOKING APPARATUS WITH REMOVABLE GRILLS

BACKGROUND OF THE INVENTION

1. Field of the Invention

This invention relates to cooking apparatus, and, more particularly, to cooking apparatus for use within a fireplace.

2. Background Information

The patent literature includes a number of examples of apparatus providing a surface for cooking over a fire within a fireplace, with a portion of the apparatus being fastened to one or more surfaces of the fireplaces, and with the surface to be used for cooking being adjustable but not readily removable from the portion of the apparatus fastened in place within the fireplace. For example, U.S. Pat. No. 3,834,370 describes a grill for use in a fireplace or outdoors comprises a 1 rack and pinion elevating assembly. A shaft which operates the pinion may be pushed to lock the elevating assembly and pulled to unlock the elevating assembly so that the grill may be raised or lowered. The grill may be tilted and latched in any one of several tilted positions.

U.S. Pat. No. 4,766,879 describes another example of such apparatus, in which a fireplace cooking grill is supported for vertical and horizontal adjustment in a fireplace opening with the grill being supported from a vertically disposed support post having a rack Sear along one edge thereof with the grill including a slide on the post having a manually rotatable gear mounted in a gear housing in engagement with the rack gear for vertically adjusting the grill. The rotatable gear is provided with a detachable handle, which can be removed when desired, and the gear housing includes a bracket having a horizontally disposed support member slidably supporting a grill frame and a removable grill therein which enables the grill to be vertically adjustable in relation to the fireplace and horizontally adjustable inwardly and outwardly of the fireplace to enable optimum positioning of the grill in relationship to a fire, coals, or other heat source in the fireplace.

Yet another example of such apparatus is described in U.S. Pat. No. 4,911,146, in the form of a fireplace cooking device which provides for translation a grill or other cooking device in three orthogonal directions. The device has a wall assembly, which attaches to the sidewall of the fireplace and maintains a mechanism to raise or lower a grill or other cooking device. Attached to the wall assembly are a series of elements which are pivotably mounted to provide planar translation of a grill or other cooking device.

What is needed is apparatus providing a cooking surface without a necessity for fastening a portion of the apparatus in place within the fireplace. Furthermore, what is needed is a method for readily removing the cooking surface for cleaning or to provide for other uses of the fireplace.

U.S. Pat. No. 4,086,905 describes a combination fire grate and fireplace cooking grill in which a modular design facilitates the use of various sizes of fuels, such as charcoal or wood. A lightweight handle with a coupling configuration is provided for repositioning the cooking grill with respect to the fire, and/or for removing the cooking grill and food from the fire. This coupling means is designed to quickly and positively engage the cooking grill when inserted from a direction approximately perpendicular to the cooking surface. As the handle is then displaced arcuately towards the plane of the cooking surface, a novel hook-shaped tip portion and basal portion of the coupling means of the handle matably engage appropriately formed surfaces on the cooking grill because the secure inner connection of the handle and cooking grill. Further arcuate displacement of the handle then causes a tracking portion formed on the cooking grill to disengage from stops to thereby allow the cooking grill to be moved freely to any of a variety of cooking positions, or to be removed entirely for serving. What is needed is a cooking grill having an elongated handle to allow installation and removal of the cooking grill without a need to grip a surface near a fire being held within the grate. Additionally, what is needed is a simple structure, such as slots, each open at one end, for removably engaging the cooking grill. Furthermore, what is needed is a frame mounting the cooking grill, with the frame being separate from the grate, so that the cooking apparatus can be used with an existing grate.

A conventional Hibachi unit typically includes a pair of slotted brackets that are used to hold removable cooking grills at various levels above a charcoal fire held within the Hibachi unit. Examples of such units are described in U.S. Pat. Nos. 4,256,080 and 4,413,609. What is needed is an apparatus for fireplace cooking employing slotted brackets to hold one or more removable cooking grills at various levels above a fire in the fireplace.

U.S. Pat. Nos. 4,083,354 and 4,553,525 describe portable grill apparatus including a food grill adjustably clamped to an upstanding elongated member supported by a foot assembly. The device can be used to hold the food grill over a fire in an outdoor campsite or in a fireplace. What is needed is a frame for removably holding one or more cooking grills behind a fire within a fireplace.

SUMMARY OF THE INVENTION

In accordance with a first aspect of the invention, apparatus is provided for cooking food within a fireplace having a space for building a fire. The apparatus includes a food grill and a frame. The food grill includes a food support surface and an elongated handle extending from a proximal end of the food support surface. The frame includes a coupling portion, a support portion, and a base portion. The coupling portion removably accepts a distal end of the food grill to hold the food grill to extend horizontally outward from the coupling portion, above the space for building a fire. The support portion extends downward from the coupling portion to be disposed behind the space for building a fire. The base portion extends outward from a lower end of the support portion to be disposed along a floor of the fireplace below the space for building a fire.

It is understood that the space for building a fire is disposed upward from the floor of the fireplace, for example, by a conventional grate holding wood or other fuel, so that air can be brought upward through the grate to support combustion. The upward and downward directions are accorded their ordinary meanings with the cooking apparatus sitting in the fireplace under conditions of normal use. The outward direction is understood to be the direction extending outward from the fireplace opening into a room. A food grill in place within the apparatus is understood to have a proximal end facing in this outward direction and a distal end held by the frame.

DETAILED DESCRIPTION OF THE INVENTION

Figure 1:
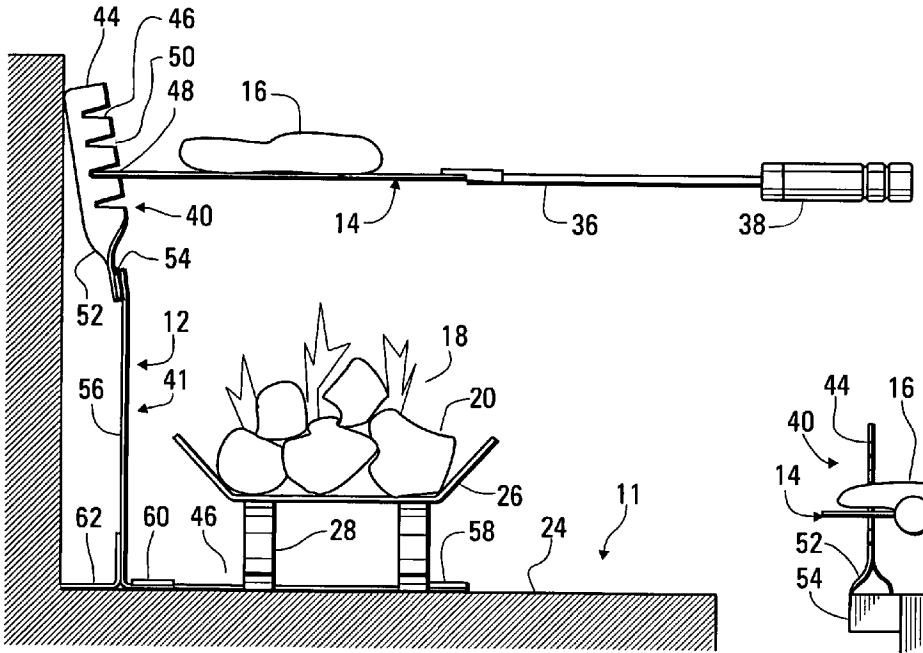
FIG. 1 is a left elevation of cooking apparatus built in accordance with the invention, shown within a fireplace.
Figure 2:
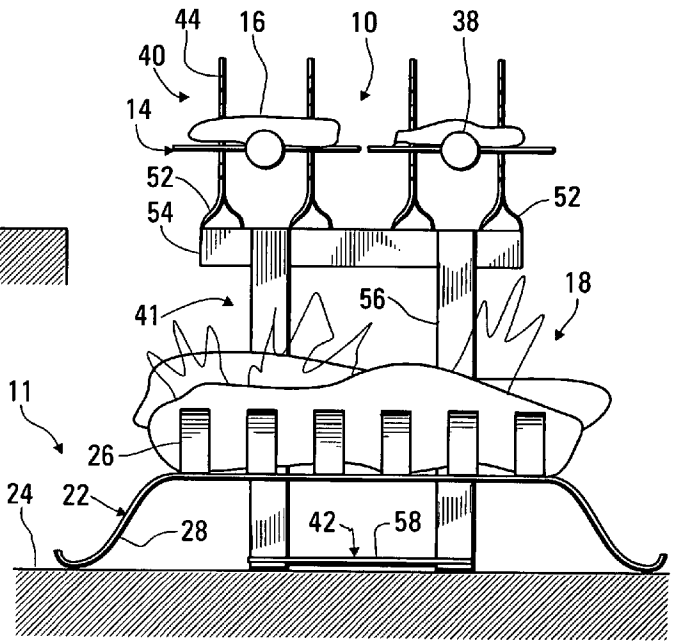
FIG. 2 is a front elevation of the cooking apparatus of FIG. 1, also shown within the fireplace.

FIGS. 1 and 2 show fireplace cooking apparatus 10 built in accordance with a first embodiment of the invention, as used within a fireplace 11, with FIG. 1 being a front view of the cooking apparatus 10, while FIG. 2 is a front view thereof. The cooking apparatus 10 includes a frame 12 and a pair of removably attached food grills 14. The food grills 14 hold food objects 16 above a fire 18 built using pieces of wood 20 held within a grate 22, which may be a conventional device. The grate 22 holds the wood 20 spaced above a floor 24 of the fireplace 11 to allow air to move upward between spaced-apart grate members 26 and to provide a space for the placement of fire starting materials, such as rolled paper. These grate members 26 are held in place by a descending grate support structure 28.

Figure 3:
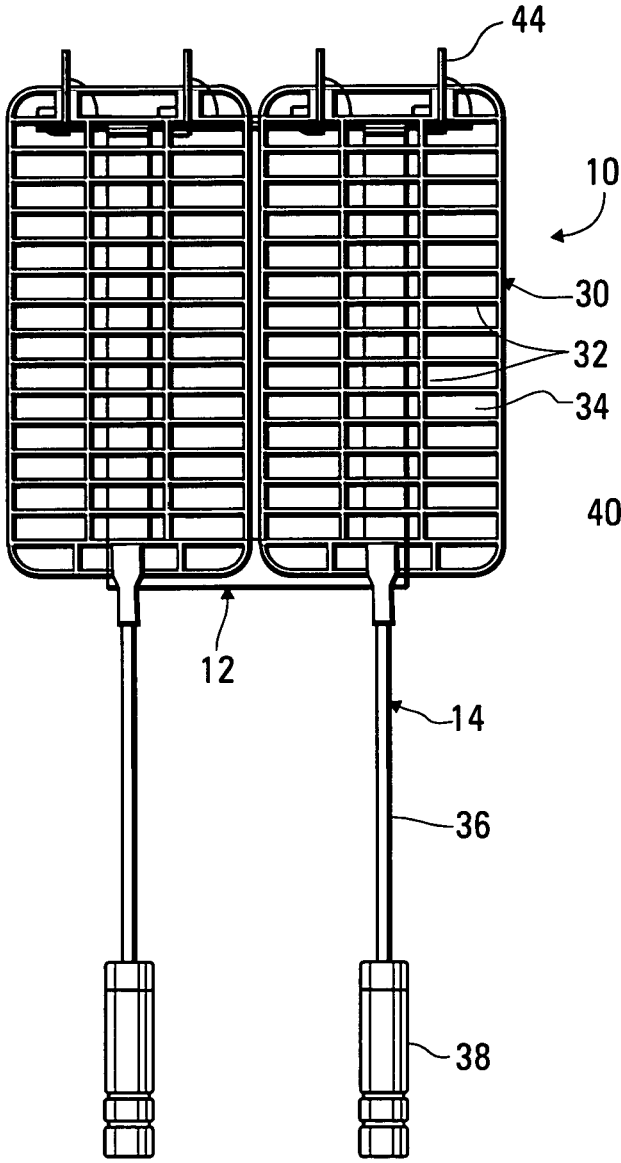
FIG. 3 is a plan view of the cooking apparatus of FIG. 1.

FIG. 3 is a plan view of the cooking apparatus 10. Each of the food grills 14 includes a generally rectangular grilling portion 30 including ribs 32 extending among rectangular spaces 34 through which the food objects 16 (shown in FIGS. 2 and 3) are heated by a combination of radiation and convection from the fire below, and through which juices are allowed to drip. The food objects 16 are additionally heated by conduction from the ribs 32. Each of the food grills 14 also includes an elongated handle 36 extending outward to a round grip 38 through a distance sufficient to allow the grill 14 to be moved without reaching near or over the fire 18.

Figure 4:
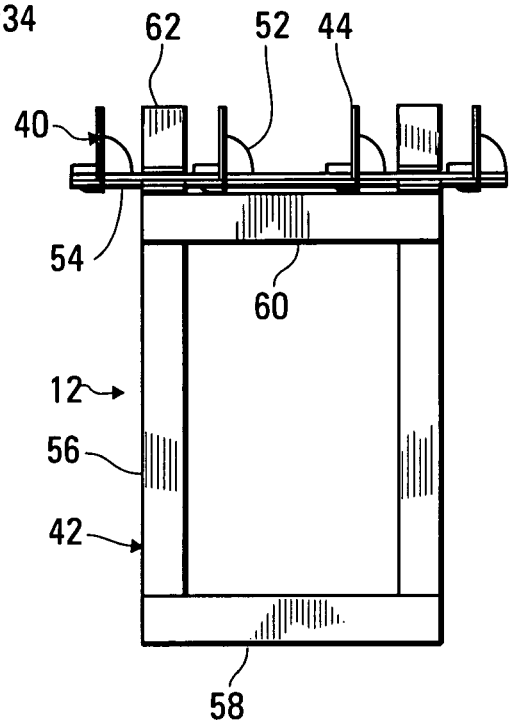
FIG. 4 is a plan view of a frame within the cooking apparatus of FIG. 1.

FIG. 4 is a plan view of the frame 12. Referring to FIGS. 1, 2 and 4, the frame 12 includes a coupling portion 40 a support portion 41, and a base portion 42. The grill attachment portion 40 includes four upstanding slotted grill attachment brackets 44, each of which includes a slotted portion having a number of grill attachment slots 46, extending between flat sides of the slotted portion from a narrow edge of the slotted portion, and arranged to accept the distal ends 48 of the food grills 14. Each of the food grills 14 can be moved vertically from one pair of slots 46 in adjacent grill attachment brackets 44 to another to vary the distance between the fire 18 and the grill 14. While each of the slots 46 has an open end 50 that is preferably enlarged to permit easy entry of the distal end 48, the slots 46 are preferably configured to hold the grills 14 to extend nearly horizontally. In the example of the figures, each of the grill attachment brackets 44 additionally includes a twisted portion 52, extending between the slotted portion of the grill attachment bracket 44 and a lower portion of the grill attachment bracket 44 providing for attachment to an upper crossbar 54, which holds the attachment brackets 44 so that each of the grills 14 is held in a pair of adjacent brackets 44, with a flat side of the lower portion of the grill attachment bracket 44 being attached to the upper crossbar 54.

The support portion 41 of the frame 12, which extends downward from the coupling portion 40, includes upper legs of a pair of L-shaped stand brackets 56 extending vertically between the upper crossbar 54 and the base portion 42, being attached to the upper crossbar 54, with the upper crossbar 54 holding the grill attachment brackets 44 horizontally spaced apart from one another and from the upper legs of the stand brackets 56. The base portion 42 includes lower legs of the L-shaped stand brackets 56. The base portion 42 additionally includes a front crossbar 56 and a rear crossbar 58 extending between the L-shaped stand brackets 56. The base portion 40 includes a pair of small L-shaped brackets 62 extending rearward from the L-shaped stand brackets 62 to provide additional stability on the fireplace floor 24.

The apparatus 10 is particularly configured to provide for supporting the food items 16 above the fire 18, built within a central portion of the fireplace 11. To this end, the support section 41 is configured to be disposed behind the fire 18 while the base portion 42 is configured to be disposed below the fire 18, extending along the floor 24 of the fireplace 11.

Using the apparatus of the present invention provides a number of advantages over the use of background art cooking methods. For example, in comparison to the use of conventional barbecue or Hibachi apparatus, or of the apparatus described in U.S. Pat. Nos. 4,256,080 and 4,413,609, the present invention provides an easy way to cook within a fireplace, so that food can be cooked over an open fire during inclement weather without leaving a building.

In comparison with the apparatus described in U.S. Pat. No. 4,086,905, the present invention provides a section for holding the food grills that is behind instead of in front of the fire, so that the fire can be more effectively used for other purposes when it is not being used for cooking. Also, the elongated handle of the present invention allows the food grills to be installed on and removed from the frame without moving one's hand close to the fire. Furthermore, the present invention provides a more straightforward method of removing, installing, and changing the position of the food grills. Additionally, the present apparatus provides cooking apparatus that can be used with a pre-existing grate.

In comparison with the apparatus described in U.S. Pat. Nos. 3,834,370, 4,911,146, and 4,766,879, the present apparatus provides the advantages of food grills that are readily removable for serving, cleaning, and for using the fireplace for purposes other than cooking, including the processes necessary to build and maintain a fire. Additionally, the present invention provides a frame that is disposed behind and under a grate within the fireplace, instead of beside the grate, as in the background are. Furthermore, the present invention is easily set in place within the fireplace, without a need to fasten or clamp the frame to structures of the fireplace.

In comparison with the apparatus described in U.S. Pat. Nos. 4,083,354 and 4,553,525, the present invention provides the advantage of a frame that is disposed behind and under a grate instead of a frame that has to be placed on the hearth in front of the fireplace, together with the advantage of food grills that are easily removable from the frame.

While apparatus including a pair of food grills has been shown and described, it is understood that similar apparatus could be built in accordance with the invention to provide for only a single food grill or for many more food grills.

While the frame 12 has been shown as being formed by welding metal strips together, it is understood that such a frame may alternately be made by bolting strips together or by casting an integral structure.

It is further understood that the right elevation of the apparatus is a mirror image of the left elevation, shown in FIG. 1, and that the rear and bottom sides of the apparatus (not shown) do not include decorative features.

While the invention has been shown in its preferred form or embodiment with some degree of particularity, it is understood that this description has been given only by way of example, and that many changes may be made without departing from the spirit and scope of the invention, as described in the appended claims.

What is claimed is:

1. Apparatus for cooking food within a fireplace having a space for building a fire, wherein said apparatus comprises:

a food grill including a food support surface and an elongated handle extending from a proximal end of said food support surface; and a frame including a coupling portion, a support portion, and a base portion, wherein said coupling portion removably accepts a distal end of said food grill to hold said food grill to extend horizontally outward from said coupling portion, wherein said coupling portion holds said food grill in a plurality of vertically spaced-apart positions above said space for building a fire, said coupling portion comprises a pair of slotted members and an upper crossbar, each of said slotted members has a slotted portion including a plurality of vertically spaced apart slots extending between flat sides of said slotted portion from a narrow edge of said slotted portion, each of said slots engages a portion of said distal end of said food grill, said upper crossbar holds said slotted members horizontally spaced apart to engage said distal end of said food grill in spaced apart positions, each of said slotted members includes a twisted portion extending between said slotted portion of said slotted member and a lower portion of said slotted member having a flat side attached to said upper crossbar, said support portion extends downward from said coupling portion to be disposed behind said space for building a fire, and said base portion extends outward from a lower end of said support portion to be disposed along a floor of said fireplace below said space for building a fire.

2. Said apparatus of claim 1, wherein said apparatus comprises a plurality of food grills each of said food grills includes a food support surface and an elongated handle extending from a proximal end of said food support surface, and said coupling portion removably accepts distal portions of all said food grills in said plurality of food grills, holding each of said food grills in a plurality of vertically spaced positions said coupling portion comprises a plurality of pairs of slotted members and an upper crossbar, each of said slotted members has a slotted portion including a plurality of vertically spaced apart slots extending between flat sides of said slotted portion from a narrow edge of said slotted portion, each of said slots engages a portion of said distal end of each food grill in said plurality of food grills, and said upper crossbar holds said pairs of slotted members horizontally spaced apart to engage said distal end of each of said food grills in spaced apart positions, and each of said slotted members includes a twisted portion extending between said slotted portion of said slotted member and a lower portion of said slotted member having a flat side attached to said upper crossbar.

3. Said apparatus of claim 1, wherein said frame includes a pair of spaced apart L-shaped brackets, said support portion of said frame includes vertically extending legs of said pair of L-shaped brackets, and said base portion of said frame includes horizontally extending legs of said pair of L-shaped brackets.

4. Said apparatus of claim 3, wherein said base portion of said frame additionally includes a lower crossbar extending between said horizontally extending legs of said pair of L-shaped brackets.

5. Said apparatus of claim 3, wherein said food support surface includes a number of ribs extending in both directions around rectangular apertures.

6. Said apparatus of claim 3, wherein said upper crossbar is attached to each of said vertically extending legs of said pair of L-shaped brackets to hold a plurality of said slotted members spaced apart from one another and from said vertically extending legs.

7. A frame for supporting a food grill for cooking food within a fireplace having a space for building a fire, wherein said frame comprises:

a coupling portion removably accepting a distal end of said food grill to hold said food grill to extend horizontally outward from said coupling portion, above said space for building a fire, wherein said coupling portion holds said food grill in a plurality of vertically spaced-apart positions; wherein said coupling portion comprises a pair of slotted members and an upper crossbar, each of said slotted members has a slotted portion including a plurality of vertically spaced apart slots extending between flat sides of said slotted portion from a narrow edge of said slotted portion, each of said slots engages a portion of said distal end of said food grill, said upper crossbar holds said slotted members horizontally spaced apart to engage said distal end of said food grill in spaced apart positions, and each of said slotted members includes a twisted portion extending between said slotted portion of said slotted member and a lower portion of said slotted member having a flat side attached to said upper crossbar;

a support portion extending downward from said coupling portion to be disposed behind said space for building a fire; and a base portion extending outward from a lower end of said support portion to be disposed along a floor of said fireplace below said space for building a fire.

8. Said frame of claim 7, wherein said coupling portion removably accepts distal portions of food grills in a plurality of food grills, holding each of said food grills in a plurality of vertically spaced positions, said coupling portion comprises a plurality of pairs of slotted members and an upper crossbar, each of said slotted members has a slotted portion including a plurality of vertically spaced apart slots extending between flat sides of said slotted portion from a narrow edge of said slotted portion, each of said slots engages a portion of said distal end of a food grill in said plurality of food grills, and said upper crossbar holds said pairs of slotted members horizontally spaced apart to engage said distal end of each of said food grills in spaced apart positions, and each of said slotted members includes a twisted portion extending between said slotted portion of said slotted member and a lower portion of said slotted member having a flat side attached to said upper crossbar.

9. Said frame of claim 7, including a pair of spaced apart L-shaped brackets, wherein said support portion includes vertically extending legs of said pair of L-shaped brackets, and said base portion includes horizontally extending legs of said pair of L-shaped brackets.

10. Said apparatus of claim 9, wherein said base portion additionally includes a lower crossbar extending between said horizontally extending legs of said pair of L-shaped brackets.

11. Apparatus for cooking food within a fireplace having a space for building a fire, wherein said apparatus comprises:

a plurality of food grills, each including a food support surface and an elongated handle extending from a proximal end of said food support surface; and a frame including a coupling portion, a support portion, and a base portion, wherein said coupling portion removably accepts a distal end of each food grill in said plurality of food grills to hold said food grill to extend horizontally outward from said coupling portion, said coupling portion holds said food grill in a plurality of vertically spaced-apart positions above said space for building a fire, said coupling portion comprises a plurality of pairs of slotted members and an upper crossbar, each of said slotted members has a plurality of vertically spaced apart slots, wherein each of said slots engages a portion of said distal end of said food grill, said upper crossbar holds said slotted members horizontally spaced apart to engage said distal end of said food grill in spaced apart positions, said support portion extends downward from said coupling portion to be disposed behind said space for building a fire, said base portion extends outward from a lower end of said support portion to be disposed along a floor of said fireplace below said space for building a fire, said frame includes a pair of spaced apart L-shaped brackets, said support portion of said frame includes vertically extending legs of said pair of L-shaped brackets, and said base portion of said frame includes horizontally extending legs of said pair of L-shaped brackets, and said upper crossbar is attached to each of said vertically extending legs of said pair of L-shaped brackets to hold a plurality of said slotted members spaced apart from one another and from said vertically extending legs.

* * * * *